US008919178B2

(12) United States Patent
Breen et al.

(10) Patent No.: US 8,919,178 B2
(45) Date of Patent: Dec. 30, 2014

(54) GUIDED KEEPER AND METHOD FOR METAL FORMING DIES

(75) Inventors: Scott M. Breen, Marne, MI (US); Joel T. Pyper, Grand Rapids, MI (US)

(73) Assignee: Standard Lifters, Inc., Grand Rapids, MI (US)

( * ) Notice: Subject to any disclaimer, the term of this patent is extended or adjusted under 35 U.S.C. 154(b) by 780 days.

(21) Appl. No.: 13/225,998

(22) Filed: Sep. 6, 2011

(65) Prior Publication Data

US 2012/0055224 A1 Mar. 8, 2012

Related U.S. Application Data

(60) Provisional application No. 61/380,516, filed on Sep. 7, 2010.

(51) Int. Cl.
*B21J 13/04* (2006.01)
*B21D 37/10* (2006.01)
*B21D 37/12* (2006.01)

(52) U.S. Cl.
CPC ..... *B21D 37/12* (2013.01)
USPC ..... 72/456; 72/344; 72/350; 72/481.1

(58) Field of Classification Search
USPC ..... 72/344, 350, 455, 456, 481.1; 100/214, 100/251, 257, 266, 315; 76/107.1
See application file for complete search history.

(56) References Cited

U.S. PATENT DOCUMENTS 2,346,297 A 4/1944 Garbe
2,487,233 A 11/1949 Gerke
2,627,313 A 2/1953 Marsilius
2,629,615 A 2/1953 Marsilius
2,663,180 A 12/1953 Benedict
2,979,004 A 4/1961 Kenville et al.
3,386,781 A 6/1968 Blazek et al.
3,474,656 A 10/1969 Kraft
3,514,166 A 5/1970 Coley
3,568,555 A 3/1971 Stroh
3,664,258 A 5/1972 Vecchi
3,730,039 A 5/1973 Fedrigo
3,897,118 A 7/1975 Wolfthal
4,003,283 A 1/1977 Janiszewski
4,080,819 A 3/1978 Hook et al.
4,135,770 A 1/1979 Doherty et al.
4,199,313 A 4/1980 Bohnenberger
4,282,736 A 8/1981 Mashburn
4,326,402 A 4/1982 Wallis
4,483,173 A 11/1984 Duhamel
4,696,180 A 9/1987 Zandel
4,732,033 A 3/1988 Smedberg et al.
4,742,746 A 5/1988 Olsson
4,765,227 A 8/1988 Balazs et al.
4,796,460 A 1/1989 Smedberg et al.
4,836,071 A 6/1989 Ersoy
(Continued)

*Primary Examiner* — Teresa M Ekiert
(74) *Attorney, Agent, or Firm* — Price Heneveld LLP

(57) ABSTRACT

A guided keeper and method for metal forming dies includes a base with a head portion and an opposite externally threaded mounting portion received in a mating die aperture. A scalloped shoulder portion with arc-shaped notches is located axially between the head and the mounting portions of the base, and a retainer ring groove is located axially between the head and the scalloped shoulder portion of the base. A cap screw is retained in the die, and has a cylindrical head received in one of the arc-shaped notches in the base to retain the base in place. A retainer ring is mounted in the ring groove in the base and retains the cap screw in place.

28 Claims, 4 Drawing Sheets

(56) References Cited

U.S. PATENT DOCUMENTS

| | | | |
|---|---|---|---|
| 5,113,736 | A | 5/1992 | Meyerle |
| 5,243,743 | A | 9/1993 | Peterson |
| 5,245,904 | A | 9/1993 | Meyerle |
| 5,722,280 | A | 3/1998 | Bodnar |
| 5,775,212 | A | 7/1998 | Takao |
| 5,788,903 | A | 8/1998 | Allgaier |
| 5,974,852 | A | 11/1999 | Nieschulz |
| 6,408,728 | B1 | 6/2002 | Tsuji et al. |
| 6,848,290 | B2 | 2/2005 | Pyper et al. |
| 6,895,797 | B2 | 5/2005 | Lowry et al. |
| 6,925,922 | B2 | 8/2005 | Manabe et al. |
| 6,986,273 | B2 | 1/2006 | Rager |
| 7,000,446 | B2 | 2/2006 | Nieschulz et al. |
| 7,004,007 | B2 | 2/2006 | Kruger et al. |
| 7,114,365 | B2 | 10/2006 | Rooney, Jr. et al. |
| 7,152,451 | B1 | 12/2006 | Cotter |
| 7,730,757 | B2 | 6/2010 | Pyper et al. |
| 7,861,569 | B2 | 1/2011 | Cotter et al. |
| 7,950,262 | B2 | 5/2011 | Pyper et al. |
| 2002/0124706 | A1 | 9/2002 | Mochizuki |
| 2007/0037434 | A1 | 2/2007 | Fedder et al. |
| 2009/0193865 | A1 | 8/2009 | Pyper et al. |

GUIDED KEEPER AND METHOD FOR METAL FORMING DIES

CROSS REFERENCE TO RELATED APPLICATION

Applicants hereby claim the priority benefits under the provisions of 35 U.S.C. §119, basing said claim of priority on related Provisional Patent Application Ser. No. 61/380,516, filed Sep. 7, 2010.

BACKGROUND OF THE INVENTION

The present invention relates to metal forming dies, and in particular to a guided keeper assembly and associated method.

Metal forming dies, such as stamping dies and the like, are well known in the art. Progressive metal forming dies are unique, very sophisticated mechanisms which have multiple stations or progressions that are aligned longitudinally, and are designed to perform a specified operation at each station in a predetermined sequence to create a finished metal part. Progressive stamping dies are capable of forming complex metal parts at very high speeds, so as to minimize manufacturing costs.

Heretofore, the dies used in metal forming presses have typically been individually designed, one-of-a-kind assemblies for a particular part, with each of the various components being handcrafted and custom mounted or fitted in an associated die set, which is in turn positioned in a stamping press. Not only are the punches and the other forming tools in the die set individually designed and constructed, but the other parts of the die set, such as stock lifters, guides, end caps and keepers, cam returns, etc., are also custom designed, and individually installed in the die set. Current die making processes require carefully machined, precision holes and recesses in the die set for mounting the individual components, such that the same are quite labor intensive, and require substantial lead time to make, test and set up in a stamping press. Consequently, such metal forming dies are very expensive to design, manufacture and repair or modify.

A modular guided keeper with a threaded bushing base which both precisely aligns the two die members, and positively limits reciprocal travel therebetween would be clearly advantageous in simplifying metal forming die constructions and reducing the costs in designing, manufacturing and repairing the same. Positive retention of the threaded bushing base in an associated die is important to insure that the same does not loosen and cause damage to the die set and/or press, which would result in expensive repair and machine downtime.

SUMMARY OF THE INVENTION

One aspect of the present invention is a guided keeper assembly for metal forming dies of the type having first and second die members mounted a spaced apart distance for reciprocation between converged and diverged positions. The guided keeper assembly includes a base having a generally cylindrically shaped, rigid body with a central aperture extending axially through a central portion of the base. The base also includes a head portion with a plurality of tool-engaging flats disposed about the margin of the head portion and configured for axially rotating the base relative to a first one of the die members. The base also includes a mounting portion disposed opposite the head portion and having an external thread detachably received and securely retained in a first threaded aperture in the first die member. The base also includes a scalloped shoulder portion disposed axially between the head portion and the mounting portion, having a plurality of arc-shaped, radially outwardly opening notches disposed about the margin of the scalloped shoulder portion, as well as a retainer ring groove disposed axially between the scalloped shoulder portion and the head portion. The guided keeper assembly further includes a guide pin having a cylindrically shaped central portion closely received in the central aperture in the base for precisely guiding reciprocal motion between the first and second die members. A first end of the guide pin has an enlarged head shaped to abut the base to positively limit travel between the first and second die members, and a second end, positioned opposite the first end, and having a locator portion that engages the second die member and precisely locates the second end of the guide pin on the second die member. The guided keeper assembly also includes a socket head cap screw having a threaded shank portion detachably received and securely retained in a second threaded aperture in the first die member at a location adjacent to the first threaded aperture, and a generally cylindrically shaped head portion with an exterior end face and an outside peripheral surface which mates with the arc-shaped notches in the scalloped shoulder portion of the base. The guided keeper assembly also includes a retainer ring detachably received and securely retained in the retainer ring groove in the base, and having an interior face disposed over at least a portion of the exterior end face of the head portion of the cap screw, whereby engagement between the outside peripheral surface of the head portion of the cap screw and an associated one of the arc-shaped notches in the scalloped shoulder portion of the base in which the same is received, positively prevents the base from unintentionally unfastening from the first threaded aperture, and engagement between the exterior end face of the head portion of the cap screw, and the interior face of the retainer ring positively prevents the cap screw from unintentionally unfastening from the second threaded aperture.

Another aspect of the present invention is a method for making a metal forming die of the type having first and second die members mounted a spaced apart distance for reciprocation between converged and diverged positions. The method includes forming a base with a generally cylindrically shaped, rigid body, and a central aperture extending axially through a central portion of the base. The base forming step includes forming a head portion with a plurality of tool-engaging flats disposed about the margin of the head portion and configured for axially rotating the base relative to the first die member. The base forming step further includes forming a mounting portion disposed opposite the head portion with an external thread, and forming a scalloped shoulder portion axially between the head portion and the mounting portion, with a plurality of arc-shaped, radially outwardly opening notches disposed about the margin of the shoulder portion. The base forming step further includes forming a retainer ring groove axially between the scalloped shoulder portion and the head portion. The method further includes forming a guide pin with a cylindrically shaped central portion shaped for close reception in the central aperture of the base for precisely guided reciprocal motion between the first and second die members, a first end with an enlarged head shaped to abut the base to positively limit travel between the first and second die members, and a second end position opposite the first end with a locator portion configured to engage the second die member. The method further includes steps of forming a first threaded aperture in the first die member shaped to threadedly receive and retain the mounting portion of the base therein, and forming a second threaded aperture in the first die member at a location adjacent to the first threaded aperture. The method further includes the step of providing a socket head cap screw with a threaded shank portion shaped for threaded reception in the second threaded aperture in the first die member, and a generally cylindrically shaped head portion with an exterior end face, and an outside peripheral surface which mates with the arc-shaped notches in the scalloped shoulder portion of the base. The method further includes the steps of providing a retainer ring shaped for reception in the retainer ring groove in the base, and screwing the base into the first threaded aperture in the first die member to a tightened condition. The method further includes the steps of screwing the threaded shank portion of the cap screw into the second threaded aperture in the first die member, locating the outside peripheral surface of the head portion of the cap screw in an adjacent one of the arc-shaped notches in the scalloped shoulder portion of the base, and tightening the cap screw to a tightened condition, whereby engagement between the cap screw and the one of the arc-shaped notches in the scalloped shoulder portion positively prevents the base from unintentionally unfastening from the first threaded aperture in the first die member. The method further includes the step of inserting the retainer ring into the retainer ring groove in the base with the interior face of the retainer ring disposed over at least a portion of the exterior end face of the head of the cap screw, whereby engagement between the interior face of the retainer ring and the exterior face of the cap screw positively prevents the cap screw from unintentionally unfastening from the second threaded aperture in the first die member. The method further includes the step of inserting the central portion of the guide pin into the central aperture of the base for precisely guiding reciprocal motion between the first and second die members.

Yet another aspect of the present invention is a threaded bushing base for a guided keeper assembly which provides superior holding strength in either a punch or a die shoe through the use of oversized threads. The threaded bushing base is installed into the die tool, and it is locked into place by a common socket head cap screw and retaining ring, such that the base cannot loosen or fall out of the die tool during operation. The threaded bushing base has a one-piece construction that is economical to manufacture through a single setup forming process, wherein the same is a machined from a single piece of bar stock material on an automatic CNC lathe, or the like. Machining of the punch, the die shoe or other die member is quick and uncomplicated. The bushing base is simple and requires no special tooling. An internal bore contour may be provided to assist in assembly of one or more anti-friction bushings. No additional machining is required to the threaded bushing base after surface treatment and/or assembly. The threaded bushing base is easy to remove and replace when necessary. The threaded bushing base and related guided keeper assembly are efficient in use, economical to manufacture, capable of a long operating life and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 21:
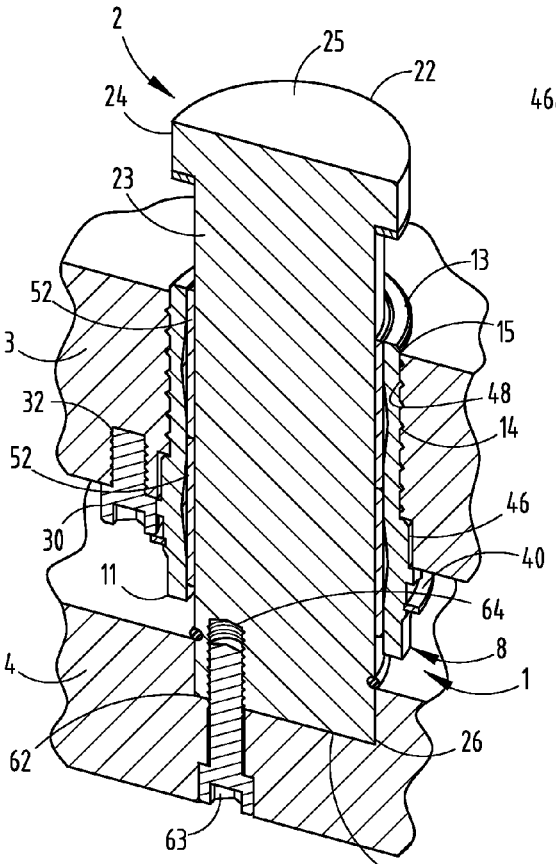
FIG. 21 is a cross-sectional perspective view of the threaded bushing base and associated guided keeper shown fully installed in two die members.

For purposes of description herein, the teems "upper", "lower", "right", "left", "rear", "front", "vertical", "horizontal" and derivatives thereof shall relate to the invention as oriented in FIG. 21. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIGS. 1-7) generally designates a threaded bushing base for use in conjunction with a guided keeper assembly 2 of the type used in the construction of metal forming dies having first and second die members 3, 4 mounted a spaced apart distance for reciprocation between converged and diverged positions. The term "die member," as used herein, generically refers to either a stationary die member, such as die shoe, or a reciprocating die member, such as die pad 4. In the embodiment illustrated in FIG. 2, threaded bushing base 1 is shown mounted in a stationary die shoe 3, which is located below a reciprocating die pad 4. In the embodiment illustrated in FIG. 21, threaded bushing base 1 is mounted in the stationary die shoe 3, which is located above the reciprocating die pad 4. As is understood by those skilled in the art, the present threaded bushing base 1 and associated guided keeper assembly 2 can be mounted in either die member 3, 4, depending upon the requirements of the specific application.

Threaded bushing base 1 includes a base 8 having a generally cylindrically shaped, rigid body with a central aperture 10 extending axially through a central portion of base 8. Base 8 also has a head portion 11 with a plurality of tool engaging flats 12 disposed about the margin of the head portion 11 and configured for axially rotating base 8 relative to the associated die member, such as the stationary die shoe 3 shown in FIGS. 2-5. Base 8 also has a mounting portion 13 disposed opposite head portion 11, with an external thread 14 detachably received and securely retained in a first threaded aperture 15 in die shoe 3. Base 8 also includes a scalloped shoulder portion 16 disposed axially between head portion 11 and mounting portion 13, and including a plurality of arc-shaped, radially outwardly opening notches 17 disposed about the margin of scalloped shoulder 16. Base 8 also includes a retainer ring groove 18 disposed axially between scalloped shoulder portion 16 and head portion 11. The guided keeper 2 associated with threaded base assembly 1 has a guide pin 22 with a cylindrically shaped central portion 23 closely received in the central aperture 10 in base 8 for precisely guiding reciprocal motion between the first and second die members 3, 4. The guide pin 22 has a first end 24 with an enlarged head 25 shaped to abut base 8 to positively limit travel between the first and second die members 3, 4. Guide pin 22 also has a second end 26 positioned opposite first end 24, and having a locator portion 27 that engages the illustrated reciprocating die pad 4, and precisely locates the second end 26 of guide pin 22 on the die pad 4. A socket head cap screw 30 has a threaded shank portion 31 detachably received and securely retained in a second threaded aperture 32 in a die shoe 3 at a location adjacent to the first threaded aperture 15, and a generally cylindrical head portion 33 with an exterior end face 34, and an outside peripheral surface 35 which mates with the arc-shaped notches 17 in the scalloped shoulder portion 16 of base 8. A retainer ring 40 is detachably received and retained in the retainer ring groove 18 in base 8, and has an interior face 41 disposed over at least a portion of the exterior end face 34 of the head portion 33 of cap screw 30, such that engagement between the outside peripheral surface 35 of the head portion 33 of cap screw 30 and an associated one of the arc-shaped notches 17 on the scalloped shoulder portion 16 of base 8 in which the same is received, positively prevents base 8 from unintentionally unfastening from the first threaded aperture 15 in die shoe 3, and an engagement between the exterior end face 34 of the head portion 33 of cap screw 30 and the interior face 41 of retainer ring 40 positively prevents cap screw 30 from unintentionally unfastening from the second threaded aperture 32 in die shoe 3.

Figure 2:
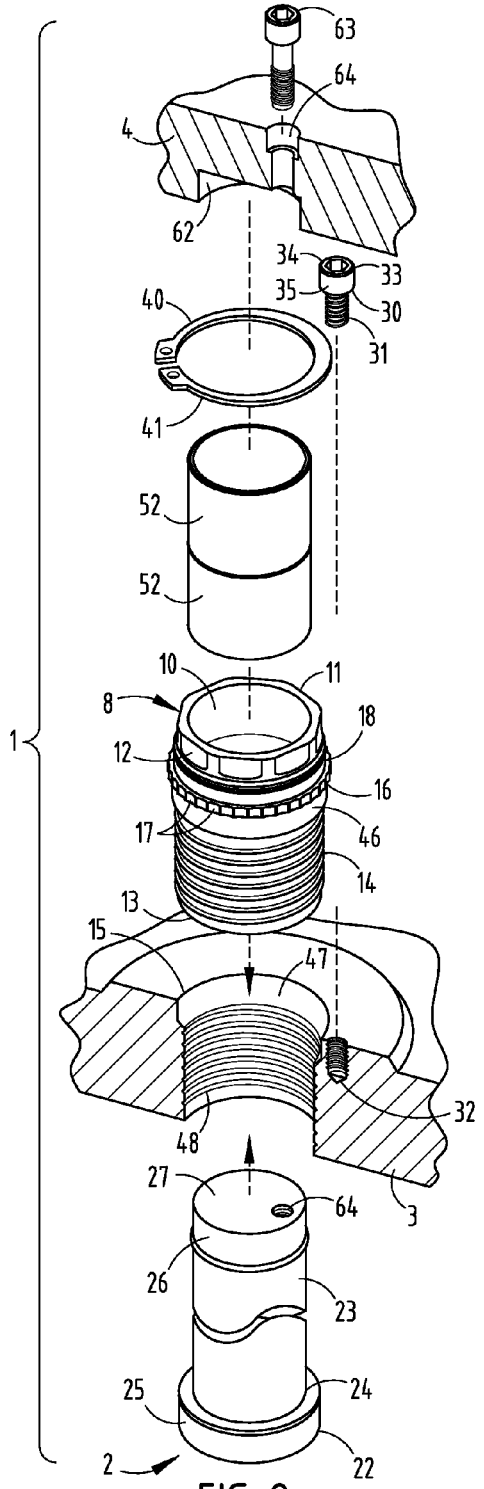
FIG. 2 is an exploded perspective view of the threaded bushing base and associated guided keeper guide pin for mounting in a die member.
Figure 6:
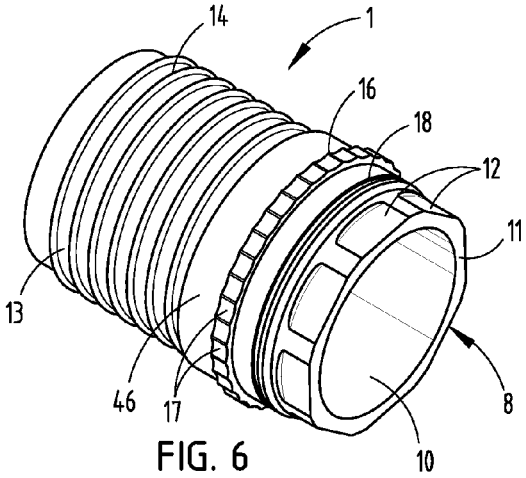
FIG. 6 is a perspective view of a base portion of the threaded bushing base.
Figure 7:
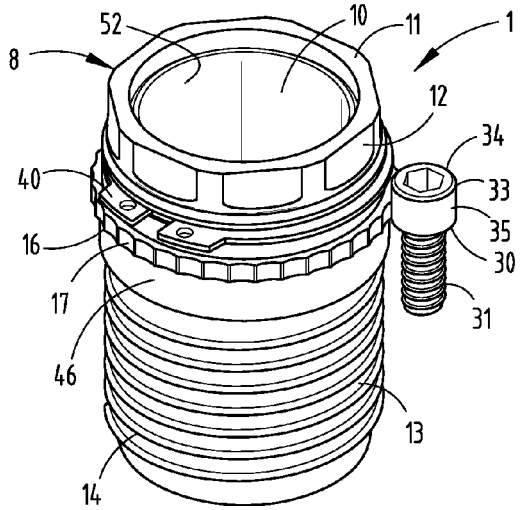
FIG. 7 is a perspective view of the threaded bushing base.
Figure 8:
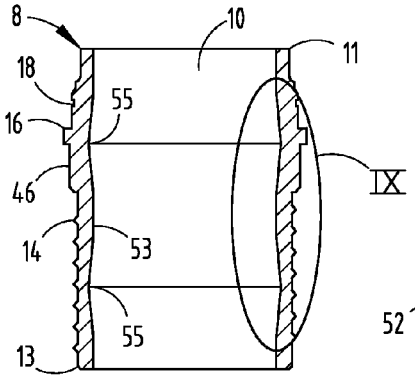
FIG. 8 is a longitudinal cross-sectional view of the base portion.

In the example illustrated in FIGS. 2 and 21, the locator end 27 of guide pin 23 is mounted in a reciprocating die pad 4 of the metal forming die, and the threaded bushing base 1 is mounted in a stationary die shoe 3. Reciprocating die pad 4 shifts relative to stationary die shoe 3 in a precisely guided and retained manner by a plurality of guided keeper assemblies 2. However, as will be appreciated by those having ordinary skill in the art, threaded bushing base 1 can be mounted in any portion of the metal forming die which requires both guidance and retention between two reciprocating die members 3, 4.

Figure 9:
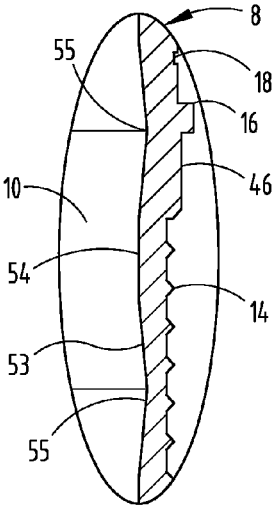
FIG. 9 is an enlarged cross-sectional view of a contoured side wall area of the base portion.
Figure 10:
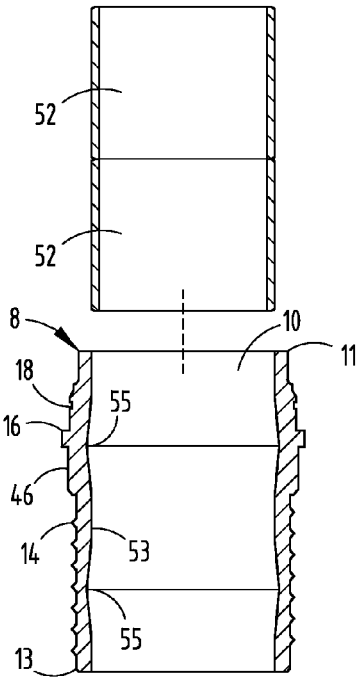
FIG. 10 is an exploded cross-sectional view of a threaded bushing base assembly into which bushings are shown being assembled.
Figure 11:
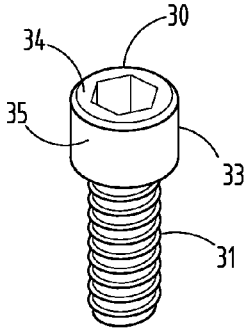
FIG. 11 is a perspective view of a socket head cap screw portion of the threaded bushing base.
Figure 12:
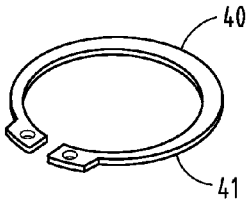
FIG. 12 is a perspective view of a retainer ring portion of the threaded bushing base.

In the illustrated example, the base 8 (FIGS. 6-10) includes a finished, non-threaded or smooth locator shoulder 46 which is disposed axially between mounting portion 13 and scalloped shoulder portion 16. As best shown in FIG. 2, the first threaded aperture 15 in die shoe 3 includes a finished, non-threaded or smooth bore portion 47 and a threaded portion 48 disposed axially interior of the finished non-threaded bore portion 47. The finished non-threaded locator shoulder 46 on base 8 is closely received in the finished non-threaded bore portion 47 of the first threaded aperture 15 to accurately locate base 8 in die shoe 3. In the example illustrated in FIGS. 6-10, the threaded bushing base 1 includes two anti-friction bushings 52 which are inserted into the central aperture 10 of base 8 in an end-to-end relationship, and serve to provide a smooth bearing surface which mates with the exterior surface of guide pin 22 for sliding reciprocation. As best illustrated in FIG. 9, the interior side wall 53 which defines central aperture 10 may be provided with a contoured bore, which, in the illustrated example, includes alternating ridges 54 and valleys 55 which reduce the force required to press the bushings 52 into base 8, and also provide excellent bearing location, retention and running fit with the guide pin 22.

Figure 16:
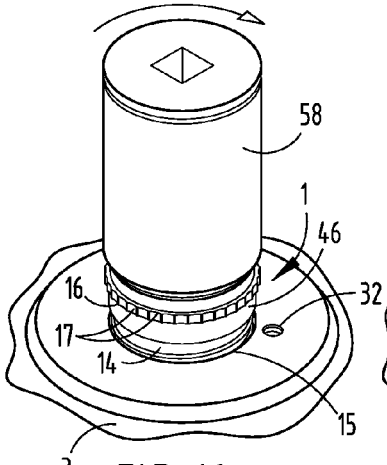
FIG. 16 is a perspective view of the base portion of the threaded bushing base with a tool used to tighten the base portion into the die member.
Figure 17:
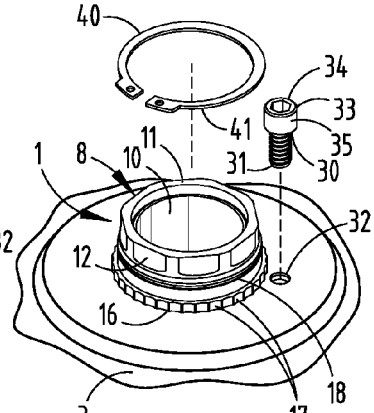
FIG. 17 is an exploded perspective view of the base portion of the threaded bushing base fully installed in the die member.
Figure 18:
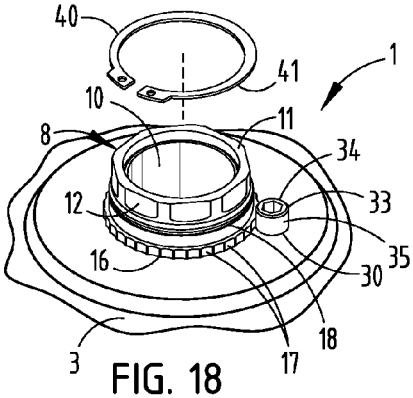
FIG. 18 is a perspective view of the threaded bushing base with a cap screw mounted in the die member.
Figure 19:
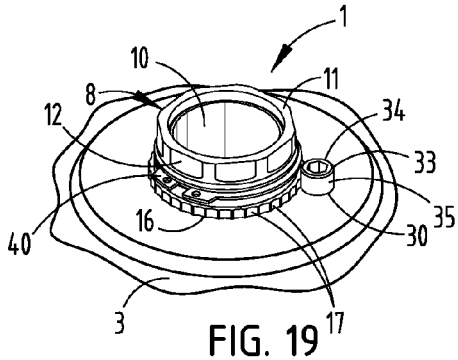
FIG. 19 is a perspective view of the threaded bushing base with a snap ring shown attached to the base portion of the assembly.

As best illustrated in FIGS. 13-19, the flats 12 on the base 8 of the threaded bushing base 1 comprise a plurality of flats arranged in a regular polygon pattern, such as a hexagon, an octagon, or the like, which are suitable for engagement with a conventional wrench, such as the illustrated wrench socket 58 shown in FIG. 16. Furthermore, the illustrated retaining ring 40 comprises a conventional split snap ring which is securely, yet detachably retained in the retainer ring groove 18 in base 8.

As best illustrated in FIGS. 1-5, the scalloped shoulder portion 16 of base 8 includes a plurality of uniformly shaped, and equally spaced apart notches 17 extending continuously about the margin of scalloped shoulder 16. In the example shown in FIGS. 1-5, scalloped shoulder 16 has approximately 40-60 notches 17, which facilitates accurate alignment with the head portion 33 of cap screw 30 and secure positive mating contact therebetween. Also, the threads 14 on the mounting portion 13 of base 8 are oversized, with relatively deep roots and coarse taper, so as to provide superior holding strength in a punch, die pad 4, die shoe 3, or the like.

Figure 1:
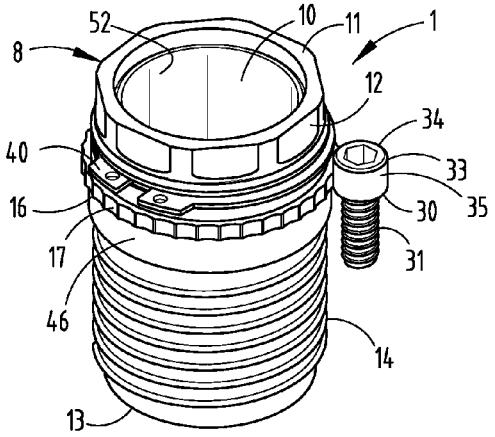
FIG. 1 is a perspective view of a threaded bushing base portion of a guided keeper assembly embodying the present invention.
Figure 3:
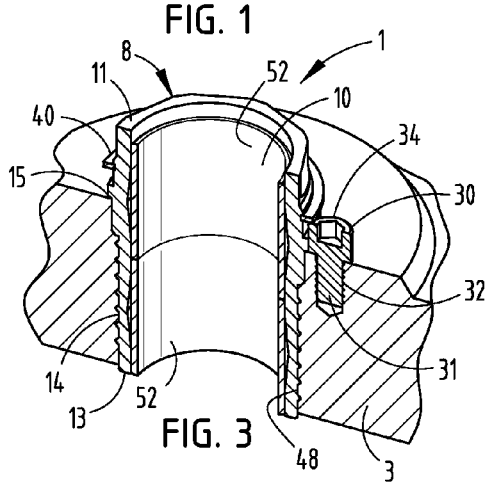
FIG. 3 is a cross-sectional perspective view of the threaded bushing base shown mounted in the die member.
Figure 4:
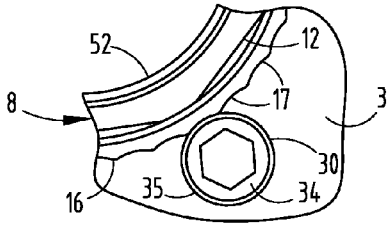
FIG. 4 is an enlarged plan view of the threaded bushing base retained in place by a cap screw.
Figure 5:
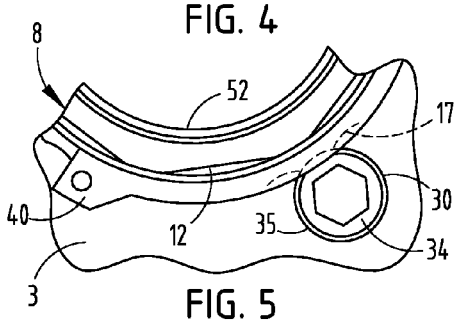
FIG. 5 is an enlarged plan view of the threaded bushing base of FIG. 4, shown after assembly of a retaining ring on a base portion of the assembly.
Figure 13:
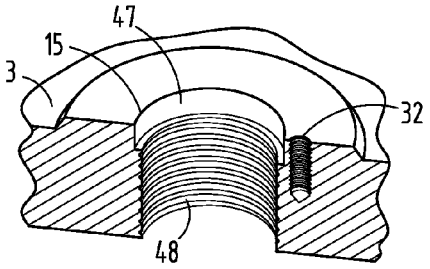
FIG. 13 is a cross-sectional perspective view of a die member machined for reception of the threaded bushing base therein.
Figure 14:
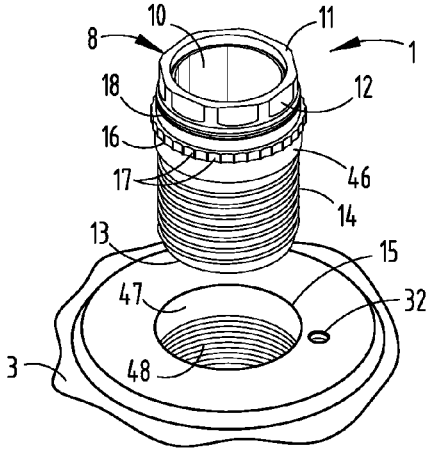
FIG. 14 is an exploded perspective view of the base portion of the threaded bushing base being assembled into the machined aperture in the die member.
Figure 15:
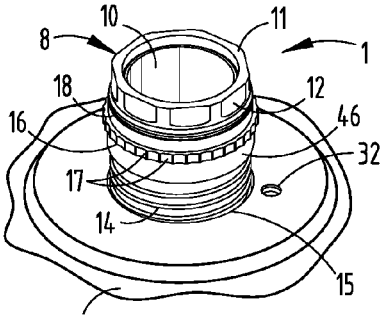
FIG. 15 is a perspective view of the base portion of the threaded bushing base partially screwed into the die member.
Figure 20:
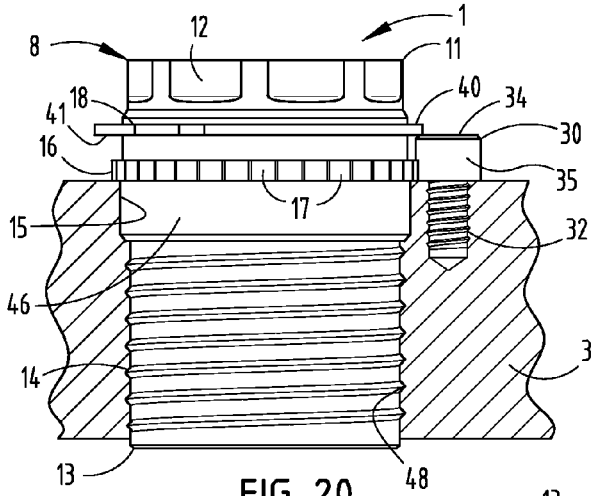
FIG. 20 is a cross-sectional view of the threaded bushing base shown fully installed in the die member.

As best illustrated in FIGS. 13-21, threaded bushing base 1 may be mounted in a die member 3, 4, such as the illustrated die shoe 3, in the following manner. The threaded apertures 15 and 32 are first formed in the die shoe 3, as best shown in FIG. 13. In the orientation illustrated in FIGS. 13-20, aperture 15 is formed completely through die shoe 3, with the smooth bore portion 47 thereof opening upwardly, and the threaded portion 48 thereof extending downwardly through die shoe 3. Threaded aperture 32 is a blind hole, which opens through the upper surface of die shoe 3 at a location parallel with and radially adjacent to aperture 15. The base 8 of threaded bushing base 1 is then positioned over and aligned with aperture 15, as shown in FIG. 14, and then hand tightened into base 8 in the manner shown in FIG. 15. A tool, such as the illustrated wrench socket 58 is then placed over the flats 12 formed on base 2, and then rotated to securely tighten base 8 into place in die shoe 3. Next, wrench socket 58 is removed, and cap screw 30 is threadedly inserted into aperture 32, with the head portion 33 vertically aligned with and closely received in an aligned one of the notches 17 in the scalloped shoulder portion 16 of base 8 as shown in FIGS. 4 and 5. Cap screw 30 thereby positively prevents base 8 from unintentionally unfastening from the threaded aperture 15 in die shoe 3. Next, retainer ring 40 is inserted into the retainer groove 18 in base 8, such that the interior face 41 of retainer ring 40 is positioned closely over at least a portion of the exterior end face 34 of cap screw 30, as best shown in FIGS. 5 and 20. Consequently, engagement between the interior face 41 of retainer ring 40 and the exterior end face 34 of cap screw 30 positively prevents cap screw 30 from unintentionally unfastening from the threaded aperture 32 in die shoe 3. Base 8 cannot loosen or fall out of the tool during operation.

After the threaded bushing base 1 has been completely assembled onto die shoe 3, the locator end 27 of guide pin 22 is inserted into and through the bushings 52 in base 8, and securely attached to the die pad 4. In the illustrated example (FIG. 2), a recess 62 is formed in the upper surface of die pad 4 (as oriented in FIG. 2) and is shaped to closely receive therein the locator end 27 of guide pin 22. One or more fasteners 63 are inserted through die pad 4 into threaded apertures 64 in the locator end 27 of guide pin 22 to securely mount guide pin 22 on die pad 4, yet permit reciprocation between die shoes 3 and 4. Preferably, fastener apertures 64 are located in an offset radial position relative to the central axis of guide pin 22 to prevent rotation of guide pin 22 in die pad 4.

As will be appreciated by those skilled in the art, the locator end 27 of guide pin 22 can be attached to die pad 4 using a variety of different fastening techniques, including those which do not require recess 62, such that pin shoulder 27 is abuttingly supported directly on the flat face of die pad 4. Dowels and/or other locating mechanisms, including fixed and removable center posts or pins, such as those disclosed in U.S. Pat. No. 7,730,757, may be employed to insure proper alignment between guide pin 22 and die pad 4.

Threaded bushing base 1 can be quickly and easily removed from die shoe 3 for replacement by simply reversing the step sequence outlined above.

The base 8 of threaded bushing base 1 can be efficiently manufactured from a single piece of bar stock material. A length or section of bar stock material is placed into an automatic CNC lathe or other similar machining device that is centered in a single setup operation. The flats 12 and scalloped shoulder 16, as well as the locator shoulder 46 and the threaded mounting portion 13 are formed in the bar stock during the single set up operation. Consequently, tolerances can be held tighter because of the single setup operation, and economy of manufacturing cost is realized. After the base is formed, it can be surface coated, and bushings 52 are press fit within the central aperture 10 of base 8 when desired, as discussed above.

Figure 22:
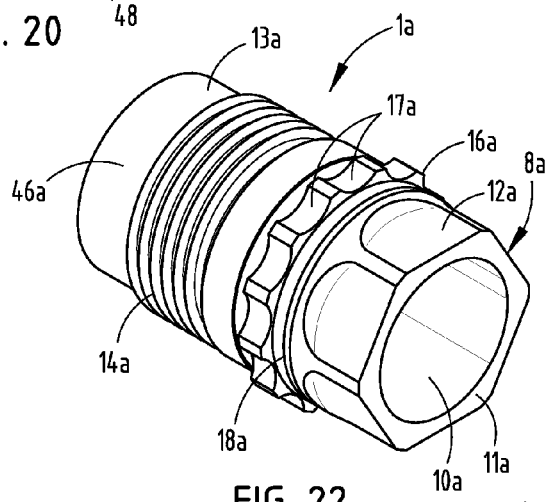
FIG. 22 is a perspective view of a base portion of another embodiment of the present invention.
Figure 23:
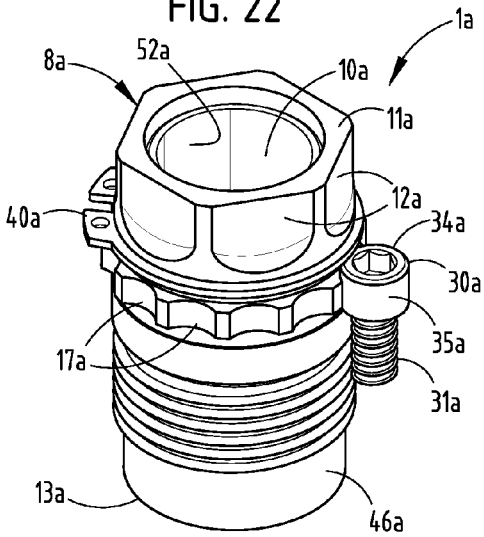
FIG. 23 is a perspective view of the alternative threaded bushing base illustrated in FIG. 22, shown in a fully assembled condition.

The reference numeral 1*a* (FIGS. 22-23) designates another embodiment of the present invention wherein flats 12, scalloped shoulder 16 and thread 14 have a somewhat different construction than those of previously described threaded bushing base 1. Since threaded bushing base 1*a* is similar to the previously described threaded bushing base 1, similar parts appearing in FIGS. 1-21 and FIGS. 22-23, respectively, are represented by the same, corresponding reference numerals, except for the suffix "a" in the numerals of the latter. In the threaded bushing base 1*a* illustrated in FIGS. 22 and 23, the flats 12*a* on base 8*a* are arranged in a hexagonal configuration, instead of the octagonal configuration of base 8. Furthermore, the scalloped shoulder 16*a* of base 8*a* includes a total of 10 to 12 notches 17*a*, whereas the scalloped shoulder 16 of base 8 has 40-60 notches 17. Also, the threaded mounting portion 13*a* of base 8*a* is somewhat shorter than that of base 8.

In the foregoing description, it will be readily appreciated by those skilled in the art that modifications may be made to the invention without departing from the concepts disclosed herein. Such modifications are to be considered as included in the following claims, as these claims by their language expressly state otherwise.

The invention claimed is:

1. In a metal forming die having first and second die members mounted a spaced apart distance for reciprocation between converged and diverged positions, the improvement of a guided keeper assembly, comprising:

a base having:

a generally cylindrically shaped, rigid body with a central aperture extending axially through a central portion of said base;

a head portion with a plurality of tool engaging flats disposed about the margin of said head portion and configured for axially rotating said base relative to said first die member;

a mounting portion disposed opposite said head portion and having an external thread detachably received and securely retained in a first threaded aperture in said first die member;

a scalloped shoulder portion disposed axially between said head portion and said mounting portion, and including a plurality of arc-shaped, radially outwardly opening notches disposed about the margin of said scalloped shoulder portion;

a retainer ring groove disposed axially between said scalloped shoulder portion and said head portion;

a guide pin having:

a cylindrically shaped central portion closely received in said central aperture in said base for precisely guiding reciprocal motion between said first and second die members;

a first end having an enlarged head shaped to abut said base to positively limit travel between said first and second die members; and a second end, positioned opposite said first end, and having a locator portion that engages said second die member, and precisely locates said second end of said guide pin on said second die member;

a socket head cap screw having a threaded shank portion detachably received and securely retained in a second threaded aperture in said first die member at a location adjacent to said first threaded aperture, and a generally cylindrically shaped head portion with an exterior end face and an outside peripheral surface which mates with said arc-shaped notches in said scalloped shoulder portion of said base;

a retainer ring detachably received and securely retained in said retainer ring groove in said base, and having an interior face disposed over at least a portion of said exterior end face of said head portion of said cap screw, whereby engagement between said outside peripheral surface of said head portion of said cap screw and an associated one of said arc-shaped notches in said scalloped shoulder portion of said base in which the same is received positively prevents said base from unintentionally unfastening from said first threaded aperture in said first die member, and engagement between said exterior end face of said head portion of said of said cap screw and said interior face of said retainer ring positively prevents said cap screw from unintentionally unfastening from said second threaded aperture in said first die member.

2. A metal forming die as set forth in claim 1, wherein:

said first threaded aperture in said first die shoe includes a finished non-threaded bore portion and a threaded portion disposed axially interior of said finished non-threaded bore portion; and said base includes a finished non-threaded locator shoulder disposed axially between said mounting portion and said scalloped shoulder portion, and is closely received in said finished non-threaded bore portion of said first threaded aperture to accurately locate said base in said first die member.

3. A metal forming die as set forth in claim 2, wherein:

said first die member comprises a stationary die shoe; and said second die member comprises a reciprocating die pad.

4. A metal forming die as set forth in claim 3, including:

an anti-friction bushing mounted in said central aperture of said base and slidingly receiving said central portion of said guide pin therein.

5. A metal forming die as set forth in claim 4, wherein:

said central aperture of said base includes a contoured bore with a generally concave shape to facilitate insertion and secure retention of said bushing therein.

6. A metal forming die as set forth in claim 5, wherein:

said tool engaging flats on said head portion of said base comprise a plurality of flats arranged in a regular polygon pattern suitable for engagement with a conventional wrench.

7. A metal forming die as set forth in claim 6, wherein:

said retainer ring comprises a split snap ring.

8. A metal forming die as set forth in claim 7, wherein:

said base has a one-piece construction.

9. A metal forming die as set forth in claim 8, wherein:

said base is lathe machined from single length of steel bar stock material.

10. A metal forming die as set forth in claim 1, including:

an anti-friction bushing mounted in said central aperture of said base and slidingly receiving said central portion of said guide pin therein.

11. A metal forming die as set forth in claim 9, wherein:

said central aperture of said base includes a contoured bore with a generally concave shape to facilitate insertion and secure retention of said bushing therein.

12. A metal forming die as set forth in claim 1, wherein:

said first die member comprises a stationary die shoe; and said second die member comprises a reciprocating die pad.

13. A metal forming die as set forth in claim 1, wherein:

said tool engaging flats on said head portion of said base comprise a plurality of flats arranged in a regular polygon pattern suitable for engagement with a conventional wrench.

14. A metal forming die as set forth in claim 1, wherein:

said retainer ring comprises a split snap ring.

15. A metal forming die as set forth in claim 1, wherein:

said base has a one-piece construction.

16. A guided keeper for metal forming die of the type having first and second die members mounted a spaced apart distance for reciprocation between converged and diverged positions, comprising:

a base having:

a generally cylindrically shaped, rigid body with a central aperture extending axially through a central portion of said base;

a head portion with a plurality of tool engaging flats disposed about the margin of said head portion and configured for axially rotating said base relative to the first die member;

a mounting portion disposed opposite said head portion and having an external thread detachably received and securely retained in a first threaded aperture in the first die member;

a scalloped shoulder portion disposed axially between said head portion and said mounting portion, and including a plurality of arc-shaped, radially outwardly opening notches disposed about the margin of said scalloped shoulder portion;

a retainer ring groove disposed axially between said scalloped shoulder portion and said head portion;

a guide pin having:

a cylindrically shaped central portion closely received in said central aperture in said base for precisely guiding reciprocal motion between the first and second die members;

a first end having an enlarged head shaped to abut said base to positively limit travel between the first and second die members; and a second end, positioned opposite said first end, and having a locator portion shaped for engagement with the second die member, and precise location of the second end of the guide pin on the second die member;

a socket head cap screw having a threaded shank portion shaped for detachable reception and secure retention in a second threaded aperture in the first die member at a location adjacent to the first threaded aperture, and a generally cylindrically shaped head portion with an exterior end face and an outside peripheral surface which mates with said arc-shaped notches in said scalloped shoulder portion of said base;

a retainer ring detachably received and securely retained in said retainer ring groove in said base, and having an interior face disposed over at least a portion of said exterior end face of said head portion of said cap screw, whereby engagement between said outside peripheral surface of said head portion of said cap screw and an associated one of said arc-shaped notches in said scalloped shoulder portion of said base in which the same is received positively prevents said base from unintentionally unfastening from the first threaded aperture in the first die member, and engagement between said exterior end face of said head portion of said of said cap screw and said interior face of said retainer ring positively prevents said cap screw from unintentionally unfastening from the second threaded aperture in the first die member.

17. A guided keeper as set forth in claim 16, wherein:

said base includes a finished non-threaded locator shoulder disposed axially between said mounting portion and said scalloped shoulder portion, and is shaped for close reception in a finished non-threaded bore portion of the first threaded aperture to accurately locate said base in the first die member.

18. A guided keeper as set forth in claim 17, including:

an anti-friction bushing mounted in said central aperture of said base and slidingly receiving said central portion of said guide pin therein.

19. A guided keeper as set forth in claim 18, wherein:

said central aperture of said base includes a contoured bore with a generally concave shape to facilitate insertion and secure retention of said bushing therein.

20. A guided keeper as set forth in claim 19, wherein:

said tool engaging flats on said head portion of said base comprise a plurality of flats arranged in a regular polygon pattern suitable for engagement with a conventional wrench.

21. A guided keeper as set forth in claim 20, wherein:

said retainer ring comprises a split snap ring.

22. A guided keeper as set forth in claim 21, wherein:

said base has a one-piece construction.

23. A guided keeper as set forth in claim 22, wherein:

said base is lathe machined from single length of steel bar stock material.

24. A method for making a metal forming die of the type having first and second die members mounted a spaced apart distance for reciprocation between converged and diverged positions, comprising:

forming a base with a generally cylindrically shaped, rigid body and a central aperture extending axially through a central portion of the base, including:

forming a head portion with a plurality of tool engaging flats disposed about the margin of the head portion and configured for axially rotating the base relative to the first die shoe;

forming a mounting portion disposed opposite said head portion with an external thread;

forming a scalloped shoulder portion axially between the head portion and the mounting portion, with a plurality of arc shaped, radially outwardly opening notches disposed about the margin of the scalloped shoulder portion;

forming a retainer ring groove axially between the scalloped shoulder portion and the head portion;

forming a guide pin with a cylindrically shaped central portion shaped for close reception in the central aperture in the base for precisely guiding reciprocal motion between the first and second die members, a first end with an enlarged head shaped to abut the base to positively limit travel between the first and second die members, and a second end positioned opposite the first end with a locator portion configured to engage the second die member;

forming a first threaded aperture in the first die member shaped to threadedly receive and retain the mounting portion of the base therein;

forming a second threaded aperture in the first die shoe at a location adjacent to the first threaded aperture in the first die member;

providing a socket head cap screw with a threaded shank portion shaped for threaded reception in the second threaded aperture in the first die member, and a generally cylindrically shaped head portion with an exterior end face, and an outside peripheral surface which mates with the arc shaped notches in the scalloped shoulder portion of the base;

providing a retainer ring shaped for reception in the retainer ring groove in said base;

screwing the base into the first threaded aperture in the first die member to a tightened condition;

screwing the threaded shank portion of the cap screw into the second threaded aperture in the first die member, locating the outside peripheral surface of the head portion of the cap screw in an adjacent one of the arc shaped notches in the scalloped shoulder portion of the base, and tightening the cap screw to a tightened condition, whereby engagement between the cap screw and the one of the arc shaped notches in the scalloped shoulder positively prevents the base from unintentionally unfastening from the first threaded aperture in the first die member;

inserting the retainer ring into the retainer ring groove in the base with the interior face of the retainer ring disposed over at least a portion of the exterior end face of the head of the cap screw, whereby engagement between the interior face of the retainer ring and the exterior end face of the cap screw positively prevents the cap screw from unintentionally unfastening from the second threaded aperture in the first die member; and inserting the central portion of the guide pin into the central aperture of the base for precisely guiding reciprocal motion between the first and second die members.

25. A method as set forth in claim 24, wherein:

said first threaded aperture forming step includes forming a finished non-threaded bore portion of the first threaded aperture in the first die member, and forming a threaded portion of the first threaded aperture axially interior of the finished non-threaded bore portion; and said base forming step includes forming a finished non-threaded locator shoulder axially between the mounting portion and the scalloped shoulder portion, and closely receiving the same in the finished non-threaded bore portion of the first threaded aperture in the first die member to accurately locate the base in the first die member.

26. A method as set forth in claim 25, including:

selecting the first die member as a stationary die shoe; and selecting the second die member as a reciprocating die pad.

27. A method as set forth in claim 26, including:

mounting an anti-friction bushing in the central aperture of the base and slidingly receiving the central portion of the guide pin in the bushing.

28. A method as set forth in claim 27, including:

forming a contoured bore in the central aperture of the base with a generally concave shape to facilitate insertion and secure retention of the bushing therein.

* * * * *